US007611231B2

(12) United States Patent
Ito

(10) Patent No.: US 7,611,231 B2
(45) Date of Patent: Nov. 3, 2009

(54) INKJET PRINTHEAD

(75) Inventor: Atsushi Ito, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 425 days.

(21) Appl. No.: 11/258,313

(22) Filed: Oct. 26, 2005

(65) Prior Publication Data

US 2006/0092238 A1 May 4, 2006

(30) Foreign Application Priority Data

Oct. 28, 2004 (JP) ..... 2004-313873

(51) Int. Cl.
*B41J 2/045* (2006.01)
*B41J 2/05* (2006.01)

(52) U.S. Cl. ..... 347/71; 347/65

(58) Field of Classification Search ..... 347/71, 347/65

See application file for complete search history.

(56) References Cited

U.S. PATENT DOCUMENTS

| | | | | |
|---|---|---|---|---|
| 5,402,159 | A | 3/1995 | Takahashi et al. | |
| 6,692,109 | B2 * | 2/2004 | Hirota et al. | 347/54 |
| 2004/0001124 | A1 * | 1/2004 | Ito | 347/71 |

FOREIGN PATENT DOCUMENTS

| | | |
|---|---|---|
| EP | 1027990 A1 | 8/2000 |
| JP | 4341853 | 11/1992 |
| JP | 2000-218790 | 8/2000 |
| JP | 20021953 | 1/2002 |
| JP | 2004223880 | 8/2004 |

OTHER PUBLICATIONS

Translation of JP 2002001953 listed on the IDS submitted by Applicant.*

* cited by examiner

*Primary Examiner*—Matthew Luu
*Assistant Examiner*—Lisa M Solomon
(74) *Attorney, Agent, or Firm*—Banner & Witcoff, Ltd.

(57) ABSTRACT

An inkjet printhead includes a cavity unit that includes: a plurality of nozzles arranged in at least one row in a first surface of the cavity unit; at least one common ink chamber extending along the row of the nozzles so as to distribute therefrom ink to the nozzles; and an ink introducing passage having an entrance on a second surface of the cavity unit which is opposite to the first surface, and extending toward the first surface to be connected to a first one of two opposite longitudinal end portions of the common ink chamber so as to introduce ink into the common ink chamber. An uppermost stream point, in terms of ink flow, in a bottom surface of the common ink chamber is located, as seen in a direction perpendicular to a direction in which the ink introducing passage extends as well as a longitudinal direction of the common ink chamber, on a side of a second longitudinal end portion of the common ink chamber, with respect to an end point of the entrance of the ink introducing passage, which end point is on the side remote from the second longitudinal end portion.

15 Claims, 8 Drawing Sheets

INKJET PRINTHEAD

INCORPORATION BY REFERENCE

The present application is based on Japanese Patent Application No. 2004-818873 filed on Oct. 28, 2004, the content of which is incorporated herein by reference.

BACKGROUND OF THE INVENTION

1. Field of the Invention

The invention relates to a structure of an inkjet printhead applicable to an image recording apparatus and other apparatuses that record information, image or others on a recording medium by ejecting droplets of ink from nozzles.

2. Description of Related Art

As a conventional inkjet printhead, there is a piezoelectric inkjet printhead disclosed in JP-A-2004-223880 (especially FIG. 2) by the present applicant, for instance. The piezoelectric inkjet printhead includes a cavity unit, a planar piezoelectric actuator, and a flexible flat cable. The cavity unit has a plurality of nozzles, which are arranged in rows in a front surface of the cavity unit, and a plurality of pressure chambers respectively corresponding to the nozzles. The piezoelectric actuator has a plurality of active portions formed for the respectively corresponding pressure chambers. The flexible flat cable is for supplying therethrough electric power to the piezoelectric actuator.

In the cavity unit, there are formed complex ink passages for the respective nozzles. That is, a plurality of common ink chambers each of which is long in a direction in which each row of the nozzles extends, are formed inside the cavity unit, and each of the ink passages extends from one of a plurality of ink supply ports to the nozzle via one of the common ink chambers and one of the pressure chambers. Thus, ink supplied from an ink supply source into the cavity unit via the ink supply port is first introduced into the common ink chamber, and then distributed to all pressure chambers connected to the common ink chamber and disposed on a back surface of the cavity unit. To form such complex ink passages in a cavity unit that is a small component, the cavity unit is formed by stacking a plurality of thin flat plates in each of which through-holes and/or recesses of various sizes are formed.

In the cavity unit disclosed in the above-mentioned publication, a plurality of the ink supply ports open in the back surface at a place near a shorter edge thereof. An ink introducing passage extends from each ink supply port in a direction of stacking of the plates (hereinafter referred to as "the stacking direction"), namely, toward a front side of the cavity unit, and is connected to one of two opposite longitudinal ends of one of the common ink chamber that is formed through plates disposed in the middle of the stack of the plates of the cavity unit. The ink supply ports are covered by a filter member having a filtering portion in order to prevent introduction of foreign material into the cavity unit.

As described above, the cavity unit is constituted by a plurality of plates, and the ink introducing passage extending in the stacking direction is constituted by an ink supply port formed through a cavity plate constituting the back surface of the cavity unit, and two connection openings respectively formed through a base plate and a supply plate interposed between the cavity plate on the back side and two manifold plates through which the common ink chambers are formed. Contours of each ink supply port and the corresponding connection openings are the same and aligned in the vertical direction, so as to form an ink introducing passage extending in the stacking direction. The ink introducing passage is connected to one of two opposite longitudinal end portions of the common ink chamber to form right angles with a bottom surface of the common ink chamber thereat. Thus, the ink introducing passage and the common ink chamber are connected to form an L-shaped connecting portion as seen in the direction perpendicular to the stacking direction and the longitudinal direction of the common ink chamber.

According to the above-described conventional arrangement, when the ink flows into the common ink chamber from the ink introducing passage, the ink flow should turn at a right angle along the L-shaped connecting portion between the ink introducing passage and the common ink chamber. At this place, the ink flows at a higher rate on an internal side of the L-shaped connecting portion than on an external side. Hence, a corner portion on an uppermost stream side of the common ink chamber, which side corresponds to the external side of the L-shaped connecting portion, becomes a dead water region where the ink flow stagnates, and bubbles in the ink tend to be collected and accumulated at this corner portion. Even when it is tried to remove the bubbles by sucking the accumulated bubbles along with the ink, from the side of the nozzles or the side of the ink supply source, it does not work well, since the ink does not easily flow at the corner portion.

Further, when the bubbles accumulated at the corner portion aggregate into a large mass of air in the ink introducing passage, the large air mass is inhibited from moving from the ink supply port to the upstream side by the filter member covering the ink supply port.

Consequently, the ink introducing passage is narrowed by the large air mass, thereby delaying supply of the ink through the filter member into the common ink chamber. This causes shortage in the ink supply into the common ink chamber.

In addition, an air mass having grown to some size at the corner portion may move with the ink flow to close a pressure chamber, thereby causing failure in ejection of an ink droplet from a nozzle.

SUMMARY OF THE INVENTION

This invention has been developed in view of the above-described situations, and it is an object of the invention to provide an inkjet printhead capable of quickly supplying ink as introduced into the cavity unit, to the common ink chamber, by preventing generation of bubbles and without being blocked by bubbles.

The invention provides an inkjet printhead including a cavity unit that includes: a plurality of nozzles arranged in at least one row in a first surface of the cavity unit; at least one common ink chamber extending along the row of the nozzles so as to distribute therefrom ink to the nozzles; and an ink introducing passage having an entrance on a second surface of the cavity unit which is opposite to the fit surface, and extending toward the first surface to be connected to a first one of two opposite longitudinal end portions of the common ink chamber so as to introduce ink into the common ink chamber. An uppermost stream point, in terms of ink flow, in a bottom surface of the common ink chamber is located, as seen in a direction perpendicular to a direction in which the ink introducing passage extends as well as a longitudinal direction of the common ink chamber, on a side of a second longitudinal end portion of the common ink chamber, with respect to an end point of the entrance of the ink introducing passage, which end point is on the side remote from the second longitudinal end portion.

According to this printhead, the uppermost stream point in the bottom surface of the common ink chamber at the first longitudinal end portion at which the ink introducing passage is connected with the common ink chamber, is located, as seen in a direction perpendicular to a direction in which the ink introducing passage extends as well as a longitudinal direction of the common ink chamber, on the side of the second longitudinal end portion of the common ink chamber, with respect to the end point of the entrance of the ink introducing passage, which end point is on the side remote from the second longitudinal end portion. Hence, the ink supplied through the entrance formed in the second surface of the cavity unit flows along the ink introducing passage into the common ink chamber, with its direction turning at an obtuse angle. Therefore, at a connecting portion where the ink introducing passage is connected to the common ink chamber, a difference in ink flow rate is reduced between the side near the uppermost stream side and the side remote from the uppermost stream side in the longitudinal direction of the common ink chamber, thereby preventing stagnation of the ink flow at a corner portion between a side wall and the bottom surface of the common ink chamber at the uppermost stream side. Thus, accumulation of bubbles at the corner portion is prevented. Even in a case where bubbles accumulate at the corner portion, it is possible to remove the bubbles quickly by performing a sucking operation from the side of the first surface or the side of the second surface. Accordingly, it is possible to prevent shortage in ink supply from the ink introducing passage to the common ink chamber due to presence of bubbles in or around the connecting portion.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIG. 6(*b*) is a side cross-sectional view of a connecting portion where the ink supply passage is connected to a common ink chamber, in the second embodiment;

DETAILED DESCRIPTION OF PREFERRED EMBODIMENTS

Hereinafter, there will be described presently preferred embodiments of the invention, by referring to the accompanying drawings.

Referring to FIGS. 1-5, there will be described an inkjet printhead according to a first embodiment of the invention.

Figure 1:
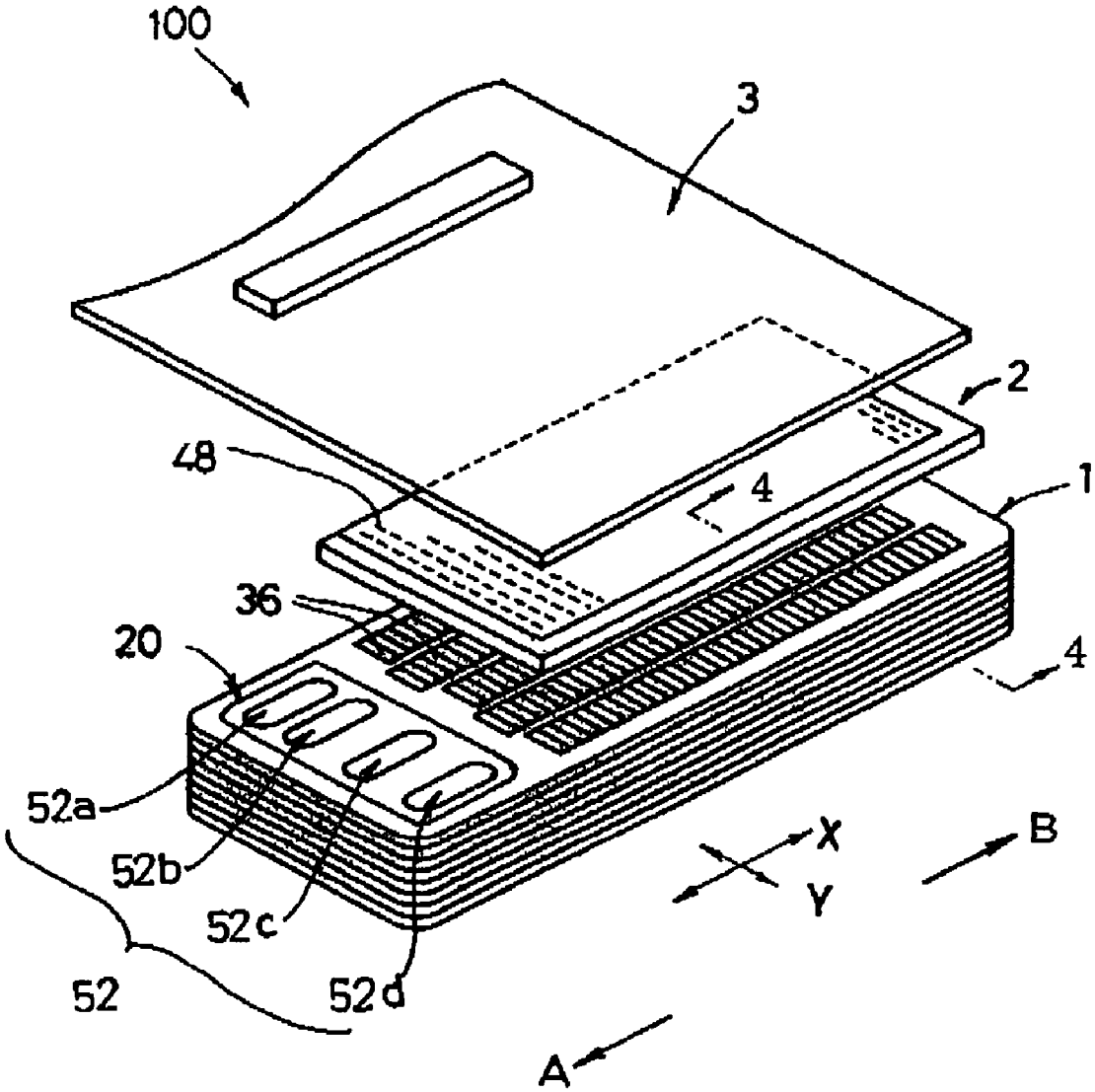
FIG. 1 is a perspective view of in inkjet printhead according to a first embodiment of the invention.
Figure 4:
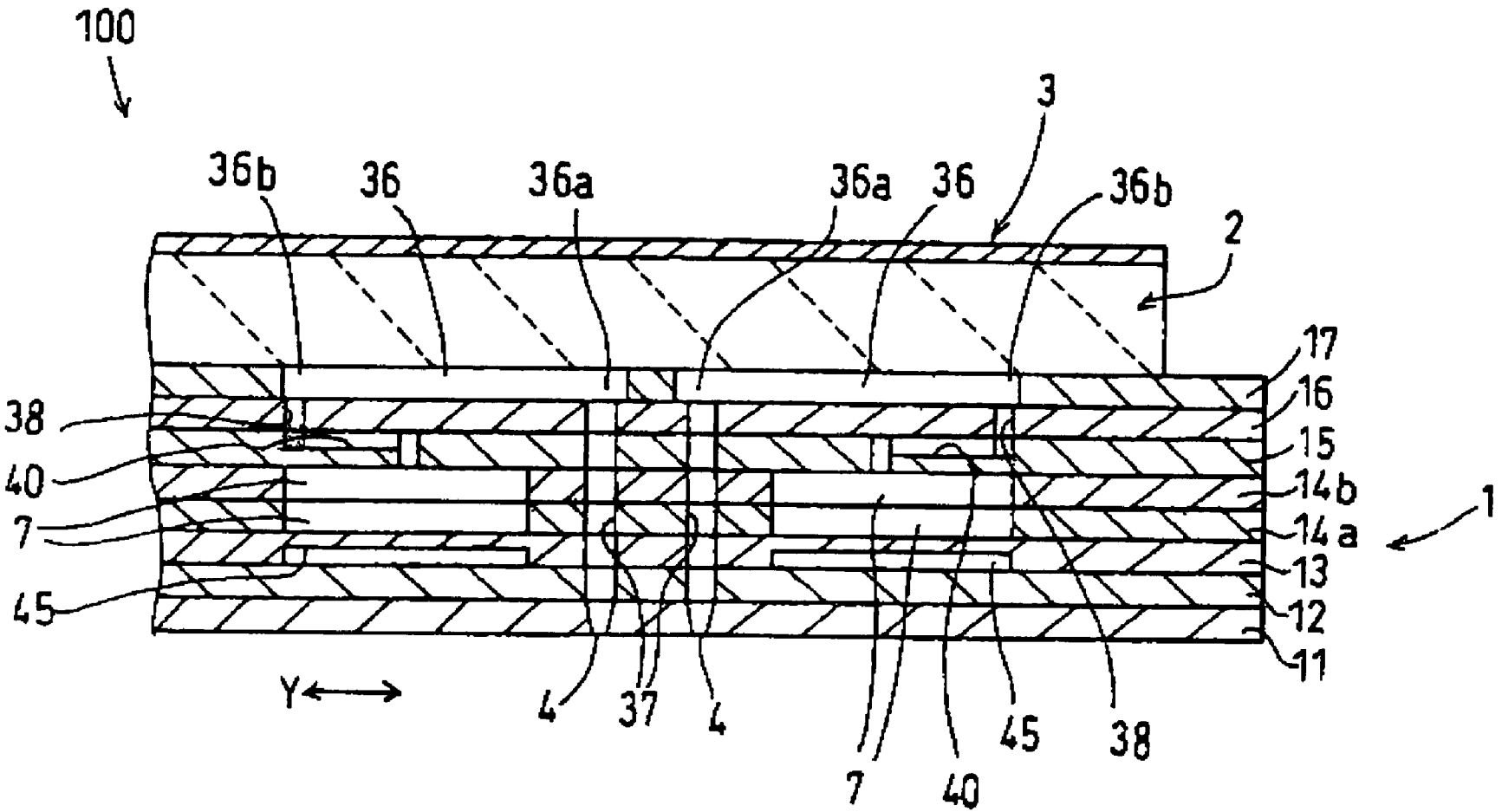
FIG. 4 is a cross-sectional enlarged view taken along line 4-4 in FIG. 1.

In FIG. 1, reference numeral 100 generally denotes a piezoelectric inkjet printhead according to the first embodiment, including a cavity unit 1 including a plurality of metallic plates, a planar piezoelectric actuator 2 fixed to the cavity unit 1, and a flexible flat cable 3 superposed on and fixed to an upper surface of the piezoelectric actuator 2, for connection with an external device. Nozzles 4 open in an under surface of the cavity unit 1 at the bottom of the inkjet printhead 100, so as to eject downward droplets of ink therefrom, as shown in FIG. 4.

There will be described a structure of the cavity unit.

Figure 2:
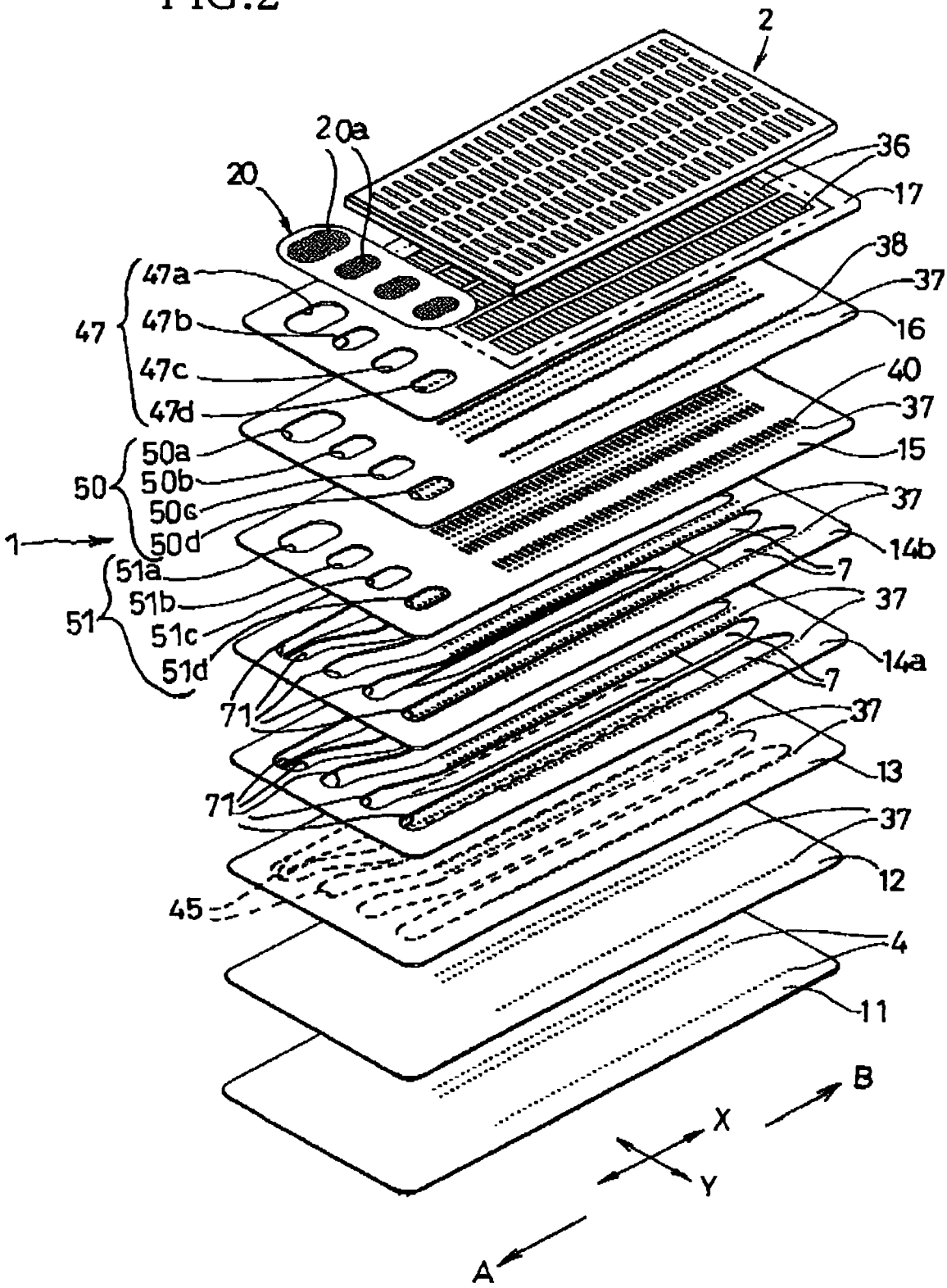
FIG. 2 is an exploded perspective view of the inkjet printhead.

As shown in FIG. 2, the cavity unit 1 is formed by stacking and bonding with an adhesive eight thin plates. The eight plates are a nozzle plate 11, a spacer plate 12, a damper plate 13, two manifold plates 14*a*, 14*b*, a supply plate 15, a base plate 16, and a cavity plate 17.

In the present embodiment, each of the plates 11-17 has a thickness of about 50-150 μm. The nozzle plate 11 is made of synthetic resin, and each of the other plates 12-17 is made of a nickel alloy steel sheet containing 42% of nickel. The nozzle plate 11 has a large number of nozzles 4 formed therethrough at very small intervals. Each nozzle 4 is for ejecting ink droplets therefrom, and has a very small diameter, i.e., about 25 μm. The nozzles 4 are arranged in five rows in a staggered fashion. Each of the five nozzle rows extends along a longitudinal direction of the nozzle plate 11, or an X-axis direction.

Figure 3:
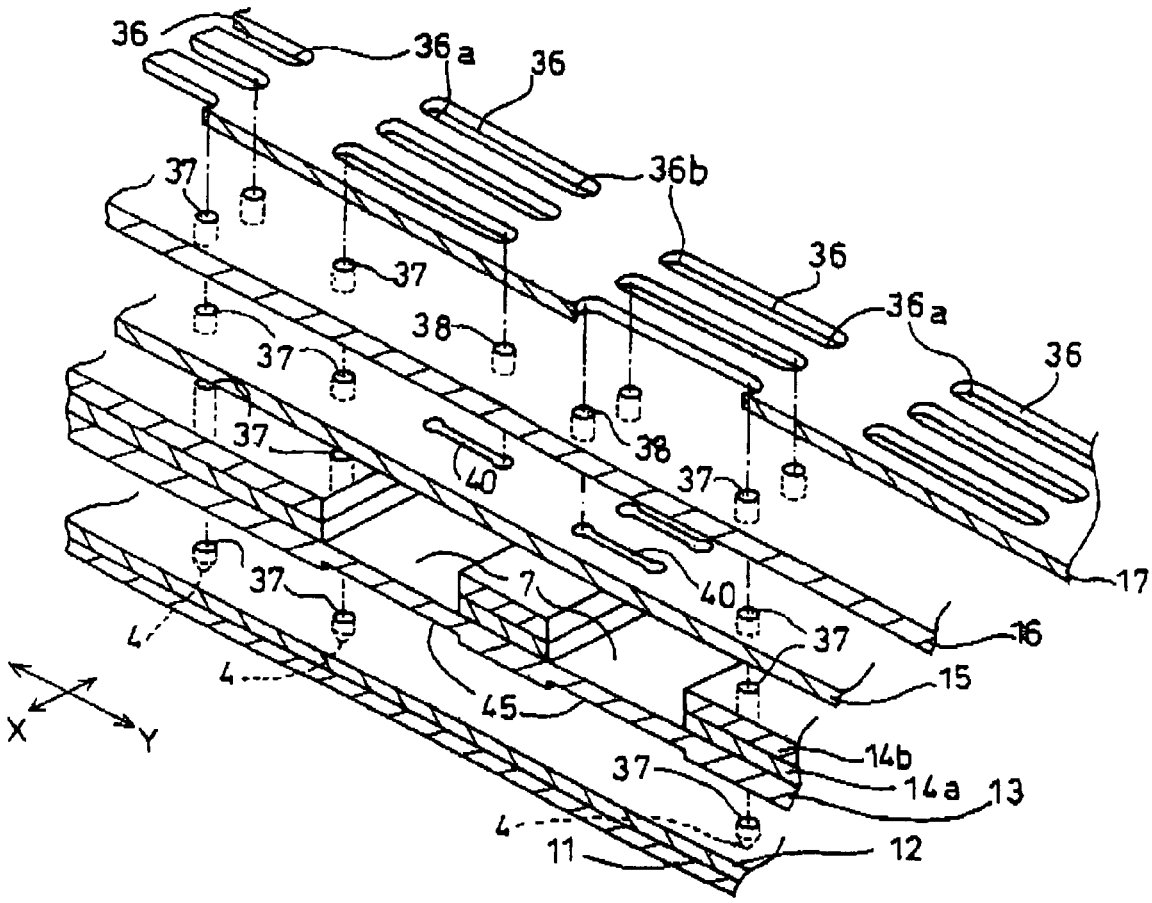
FIG. 3 is an exploded perspective view showing a cavity unit of the inkjet printhead in enlargement.

As shown in FIG. 3, the cavity plate 17 has a plurality of pressure chambers 36 formed therethrough. The pressure chambers 36 are arranged in five rows in a staggered fashion such that each pressure chamber row extends along longer sides of the cavity plate 17, or in the X-axis direction. In plan view, each of the pressure chambers 36 is elongate along shorter sides of the cavity plate 17, that is, in a Y-axis direction. A first one 36*a* of two elongate end portions of each pressure chamber 36 is in communication with a corresponding one of the nozzles 4, and a second one 36*b* or the other of the two longitudinal end portions thereof is in communication with a common ink chamber 7 as described later.

The first end portion 36*a* of the pressure chamber 36 is in communication with the nozzle 4 formed in the nozzle plate 11, via a communication hole 37 of a very small diameter that is formed through the base plate 16, supply plate 12, two manifold plates 14*b*, 14*a*, damper plate 13, and spacer plate 12. That is, communication holes 37 are formed through these plates 12-16 to be arranged in rows in a staggered fashion, similarly to the pressure chambers 36.

The base plate 16 immediately under the cavity plate 17 has through-holes 38 formed therethrough. The through-holes 38 are respectively connected with the second longitudinal end portions 36*b* of the pressure chambers 36.

The supply plate 15 immediately under the base plate 16 has connecting passages 40 formed therethrough for supplying ink from common ink chambers 7 (described later), into the pressure chambers 36. Each connecting passage 40 has an inlet through which the ink is introduced from the common ink chamber 7, an outlet open on the side of the pressure chamber 36 or the through-hole 38, and an orifice portion extending between the inlet and the outlet and having a minimum cross-sectional area to have a largest resistance to the ink flow, in the connecting passage 40.

Five common ink chambers 7 are formed through the two manifold plates 14, 14*b*, each to extend in a longitudinal direction of the manifold plates 14*a*, 14*b*, i.e., the X-axis direction. The common ink chambers 7 respectively positionally correspond to the five rows of the nozzle 4. That is, as shown in FIGS. 2 and 4, the two manifold plates 14*a*, 14*b* are stacked and an upper side of the stack of the two manifold plates 14*a*, 14*b* is covered by the supply plate 15 while an under surface thereof is covered by the damper plate 13, so that five closed common ink chambers or manifold chambers 7 are formed. Each of the common ink chambers 7 extends in a direction of extension of each pressure chamber row or each nozzle row, and overlaps a part of each of the pressure chambers 36 of a corresponding row, when seen in a direction of stacking of the plates.

As shown in FIGS. 3 and 4, on an under side of the damper plate 13 immediately under the manifold plate 14*a*, there are formed recesses or damper chambers 45 not in communication with the common ink chambers 7. As shown in FIG. 2, the positions and shapes of the damper chambers 45 coincide with those of the respectively corresponding common ink chambers 7. The damper plate 13 is made of a metallic material elastically deformable, and thus a thin ceiling portion over each damper chamber 45 is capable of vibrating to both of the side of the common ink chamber 7 and the side of the damper chamber 45. Even when a change in pressure in the pressure chamber 36 propagates to the common ink chamber 7 upon ejection of an ink droplet, the ceiling portion elastically deforms and vibrates to give a damping effect to absorb and attenuate the pressure change, thereby preventing a crosstalk that is propagation of the pressure change to another pressure chamber 36.

Through the cavity plate 17, four ink supply ports 47 (individually denoted by reference numerals 47*a*, 47*b*, 47*c*, 47*d* from left to right as seen in FIG. 2) are formed as entrances to the cavity unit 1 for the ink, as shown in FIG. 2. The base plate 16 has connection openings 50 formed therethrough (individually denoted by reference numerals 50*a*, 50*b*, 50*c*, 50*d* from left to right as seen in FIG. 2) to positionally correspond to the ink supply ports 47, The supply plate 15 has connection openings 51 formed therethrough (individually denoted by reference numerals 51*a*, 51*b*, 51*c*, 51*d* from left to right as seen in FIG. 2) to positionally correspond to the connection openings 50. The ink supply ports 47 and the connection openings 50, 51 align over longitudinal end portions of the respective common ink chambers 7, and constitute four ink introducing passages 52 (individually denoted by reference numerals 52*a*, 52*b*, 52*c*, 52*d* from left to right as seen in FIG. 1). The ink introducing passages 52 will be fully described later.

To each nozzle 4, an ink passage extends from one of the ink supply ports 47. More specifically, each of inks of respective colors is introduced into the cavity unit from an ink supply source through one of the ink supply ports 47, and then supplied into the common ink chamber 7 as an ink supply channel, via the ink introducing passage 52. Then, the ink is distributed to the pressure chambers 36 via the connecting passages 40 formed in the supply plate 15, and the through-holes 38 formed in the base plate 16, as shown in FIG. 3. By driving the piezoelectric actuator 2, the ink is flowed out from a pressure chamber 36 of interest, into the communication hole 37 to reach the nozzle 4 corresponding to that pressure chamber 36.

According to the present embodiment, four ink supply ports 47, four connection openings 50, and four connection openings 51 are formed, as shown in FIG. 2, while five common ink chamber 7 are formed. That is, the ink introducing passage 52*a* constituted by the ink supply port 47*a* and the connection openings 50*a*, 51*a* is connected to two common ink chambers 7, 7, while each of the other ink introducing passages 52 is connected to a single common ink chamber 7. To the ink supply port 47*a* or the ink introducing passage 52*a*, black ink is supplied, in view of the fact that black ink is more frequently used than the other color inks. To the ink supply ports 47*b*, 47*c*, 47*d*, yellow ink, magenta ink, and cyan ink are respectively supplied. At the ink supply ports 47*a*, 47*b*, 47*c*, 47*d*, a filter member 20 is attached with an adhesive or others. The filter member 20 has four filtering portions 20*a* at respective positions corresponding to the ink supply ports 47*a*-47*d*, as shown in FIG. 1.

There will be described a structure of the piezoelectric actuator 2. The piezoelectric actuator 2 is constructed similarly to an actuator disclosed in JP-A-4-341853, for instance. That is, the piezoelectric actuator 2 is a laminate of a plurality of piezoelectric sheets, although not shown. Each piezoelectric sheet has a thickness of about 30 μm. On an upper major surface of each even-numbered piezoelectric sheet as counted from the bottom, narrow individual electrodes are formed at positions respectively corresponding to the pressure chambers 36 in the cavity unit 1, and accordingly are arranged in rows each of which extends in the longitudinal direction of the cavity unit 1 or the piezoelectric actuator 2, i.e., the X-axis direction. On an upper major surface of each odd-numbered piezoelectric sheet as counted from the bottom, a common electrode common to a plurality of the pressure chambers 36 are formed. On an upper surface of the topmost one of the sheets, surface electrodes 48 electrically connected to the respective individual electrodes, and a surface electrode electrically connected to the common electrodes are formed.

An adhesive sheet (not shown), which is made of synthetic resin impervious to the inks, is attached to an entire under surface (i.e., the major surface opposed to the pressure chambers 36) of the planar piezoelectric actuator 2. Then, the piezoelectric actuator 2 is bonded and fixed to the cavity unit 1, with the individual electrodes of the piezoelectric actuator 2 aligned with the respectively corresponding pressure chambers 36 in the cavity unit 1. The flexible flat cable 3 is superposed on and pressed onto the upper surface of the piezoelectric actuator 2, as shown in FIG. 4, so that various wiring patterns (not shown) in this flexible flat cable 3 are electrically connected to the surface electrodes 48.

Figure 5A:
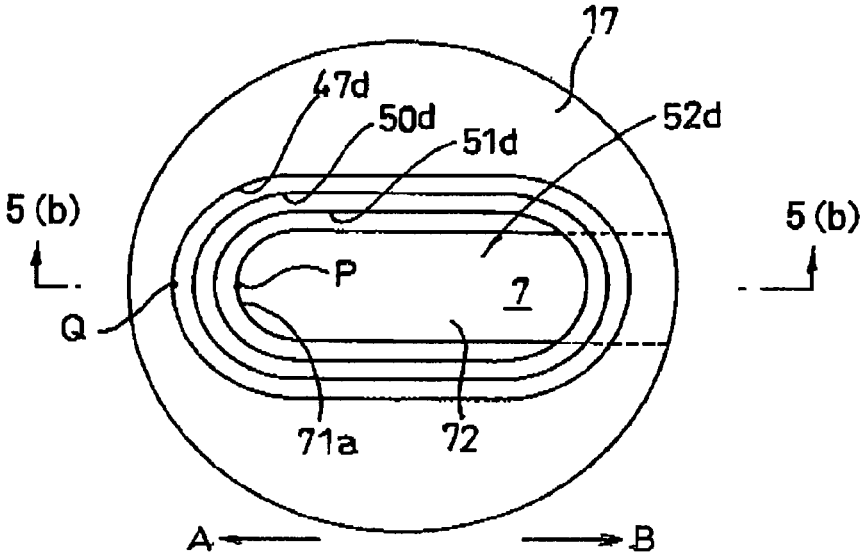
FIG. 5(*a*) is a plan view of an ink supply passage in the cavity unit, in which a filter member is removed, and FIG. 5(*b*) is a side cross-sectional view of a connecting portion where the ink introducing passage is connected to a common ink chamber.
Figure 5B:
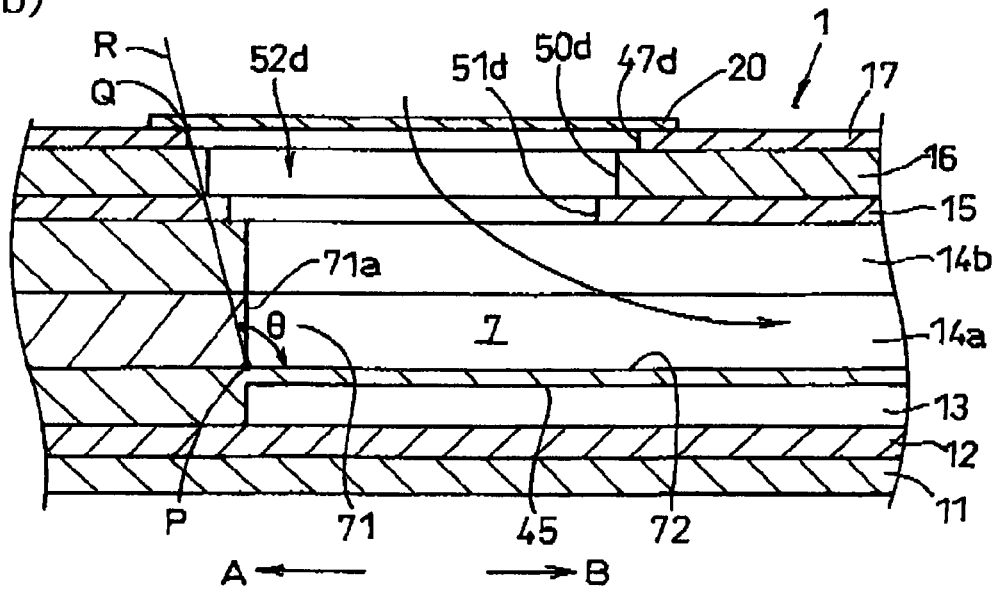

There will be now described how each ink introducing passage 52 is connected with a corresponding common ink chamber 7, by referring to FIGS. 5(*a*) and 5(*b*) that show one 52*d* of the four ink introducing passages 52.

The ink introducing passage 52*d* is connected to a first one 71 of two opposite longitudinal end portions of the common ink chamber 7, such that an uppermost stream point P in terms of the ink flow, in a bottom surface 72 of the common ink chamber 7 at the first longitudinal end portion 71 is located, as seen in a direction perpendicular to a direction in which the plates of the cavity unit are stacked as well as a longitudinal direction of the common ink chamber 7, on the side of a second longitudinal end portion of the common ink chamber 7 (i.e., on the side as indicated by arrow B) with respect to an end point Q in an open end of the ink introducing passage 52*d* on a back side that is opposite to a side where the nozzles are formed, which point Q is on the side remote from the second longitudinal end portion, i.e., on the side indicated by arrow A.

As described above, the ink introducing passage 52*d* is formed by vertically aligning the ink supply port 47*d*, and the connection openings 50*d*, 51*d*. Each of the ink supply port 47*d* and the connection openings 50*d*, 51*d* is formed in an oblong shape in plan view, and has an inner surface substantially straight in a direction of the thickness of the plates of the cavity unit. The shapes of respective openings of the ink supply port 47 and the connection openings 50*d*, 51*d* are similar but gradually decrease in size in this order, so that an inner surface of the ink introducing passage 52*d* is triple stepped with the depth dimensions of respective steps made the same. A side wall 71*a* of the common ink chamber 7, which wall 71*a* is at the downmost stream side in the first longitudinal end portion 71 of the common ink chamber 7, is located inside an open area of the connection opening 51*d*. By this arrangement, an internal diameter of the ink introducing passage 52*d* stepwise decreases from the back side of the cavity unit 1 toward its front side.

As described above, the inner surface of each of the ink supply port 47*d* and the connection openings 50*d*, 51*d* is substantially straight in the thickness direction of the plates. This means that there is implemented no special step for tapering the ink supply port 47*d* and the connection openings 50*d*, 51*d* during manufacturing of the cavity unit 1. It is noted, however, that each of the ink supply port 47*d* and the connecting openings 50*d*, 51*d* is actually slightly tapered, for the following reason. That is, although neither shown nor described explicitly above, the through-holes and recesses in the plates constituting the cavity unit are typically formed by etching. When a through-hole is formed by masking an entirety of a first side of a blank and masking the other or a second side of the blank except a place to be etched to form the through-hole, and then performing etching, the obtained through-hole is inevitably tapered to some degree such that an internal dimension of the ink supply port or the connection opening 50, 51 is larger on the second side from which the etching has been performed than the opposite side. Hence, in the present embodiment, when the ink supply port 47*d* and the connecting openings 50*d*, 51*d* are formed by etching from the upper side as seen in FIG. 5(*b*), the taper of the port 47*d* and the openings 50*d*, 51*d* smoothens the stepped inner surface of the ink introducing passage 52*d* to some degree, thereby smoothening the ink flow.

When seen in the direction perpendicular to the direction in which the plates of the cavity unit are stacked as well as the longitudinal direction of the common ink chamber 7, a phantom line R passing from the uppermost stream point P in the common ink chamber 7 to the end point Q in the open end of the ink supply port 47*d* is inclined with respect to the bottom surface 72 of the common ink chamber 7, with an angle S that is formed between the phantom line R and the bottom surface 72 obtuse or larger than 90°, as shown in FIG. 5(*b*).

Figure 8:
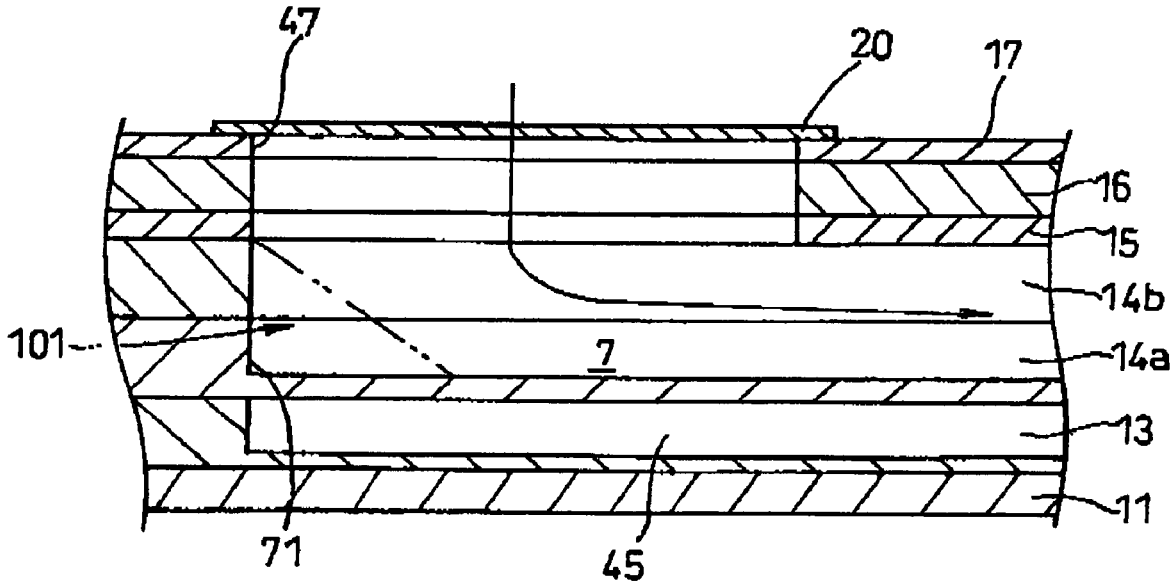
FIG. 8 is a side cross-sectional view of a connecting portion where an ink supply passage is connected to a common ink chamber, according to a conventional arrangement.

Hence, the flow of the ink as introduced through the ink supply port 47*d* turns its direction upon entering the common ink chamber 7 from the ink introducing passage 52, at an angle gentler than in the conventional arrangement where the ink flow turns at a right angle as shown in FIG. 8. Accordingly, there is reduced a difference in ink flow rate between an external part of a connecting portion at which the ink supply passage 52*d* is connected to the common ink chamber 7, i.e., a part on the side of the uppermost stream point P, and an internal side of the connecting portion, i.e., a part on the side remote from the uppermost stream point P in the longitudinal direction of the common ink chamber 7. Thus, a region where the ink flow stagnates, like a corner portion 101 shown in FIG. 8 in which is illustrated the conventional arrangement in which the ink flow turns at a right angle, does not occur, thereby preventing accumulation of bubbles around the connecting portion.

To reliably prevent the bubble accumulation, the inclination angle θ of the phantom line R desirably satisfies the following inequality: $90° < \theta \leqq 135°$, more desirably, $100° < \theta \leqq 135°$, further desirably $110° < \theta \leqq 135°$, and still further desirably $120° < \theta \leqq 135°$. When the inclination angle θ satisfies the last inequality, the ink stagnation at the corner portion 101 is reliably prevented, thereby inhibiting occurrence of a bubble there, and even when bubbles accumulate there, the bubbles are easily removable by a purge operation implemented in a maintenance work.

Figure 6A:
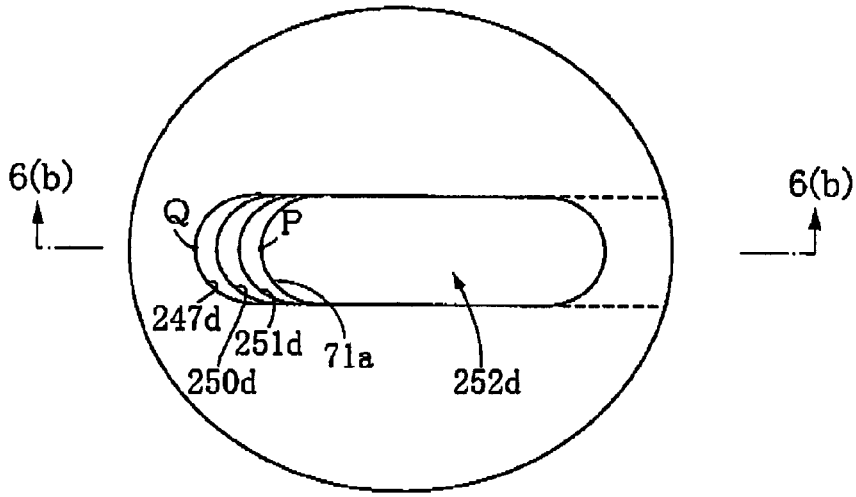
FIG. 6(*a*) is a plan view of an ink supply passage in a cavity unit according to a second embodiment of the invention, where each of two longitudinal sides of an inner surface of the ink supply passage is flat.
Figure 6B:
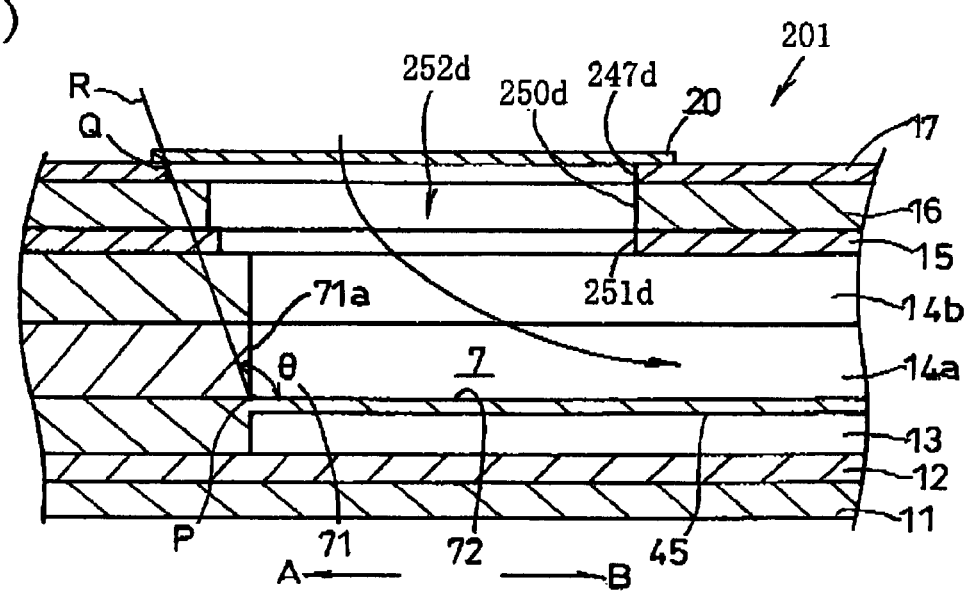

In the invention, it is not essential that the connection between the ink introducing passage 52 and the common ink chamber 7 be made in the fashion as illustrated in FIGS. 5(*a*) and 5(*b*), that is, an inner surface of the ink introducing passage 52 is stepped such that all of three shoulders have the same depth or horizontal dimension, as long as the uppermost stream point P in the common ink chamber 7 is located, as seen in the direction perpendicular to the direction in which the ink introducing passage extends as well as the longitudinal direction of the common ink chamber, on the side of the second longitudinal end portion of the common ink chamber 7 (i.e., on the side indicated by the arrow B) with respect to the end point Q in the open end of the ink introducing passage 52*d* on the side remote from the second longitudinal end portion (i.e., on the side indicated by the arrow A). In other words, merely it is essential that a portion of the inner surface of the ink introducing passage 52 which is on the side indicated by the arrow A, that is, a side of the ink introducing passage 52*d* above the uppermost stream point P in the common ink chamber, is stepped. Further, the vertical dimension and the depth or horizontal dimension may be various among steps or shoulders in the stepped inner surface of the ink introducing passage. That is, each of two longitudinal sides of the inner surface of the ink introducing passage 52 may not be stepped but may be flat with inner surfaces of the plates defining the ink introducing passage flush with one another at these sides, as shown in FIG. 6(*a*), and a part of the inner surface of the ink introducing passage 52*d* on the right side as seen in FIGS. 5(*a*) and 5(*b*), i.e., on the side of the second longitudinal end portion of the common ink chamber 7, may be stepped toward the left side in a downward direction, or may be stepped toward the right side in the downward direction as according to a third embodiment described later, Alternatively, this part of the inner surface of the ink introducing passage 52*d* may be flat and without any step, as according to a second embodiment described below.

By referring to FIGS. 6(*a*) and 6(*b*), there will be described an inkjet printhead according to a second embodiment of the invention. The parts or elements corresponding to those of the first embodiment will be denoted by the same reference numerals and description thereof is omitted.

The inkjet printhead of the second embodiment includes a cavity unit 201 that is different from the cavity unit 1 of the first embodiment in that: (i) at each of two longitudinal sides and the side indicated by arrow B, an inner surface of an ink introducing passage 252*d* is not stepped but flat, with inner surfaces of the plates defining the ink introducing passage flush with one another at these sides, as shown in FIG. 6(*a*), and (ii) the depth or horizontal dimension of steps or shoulders in the inner surface of the ink introducing passage 252*d* and on the side indicated by arrow A is various. Only one of the features (i) and (ii) may be separately employed.

Figure 7:
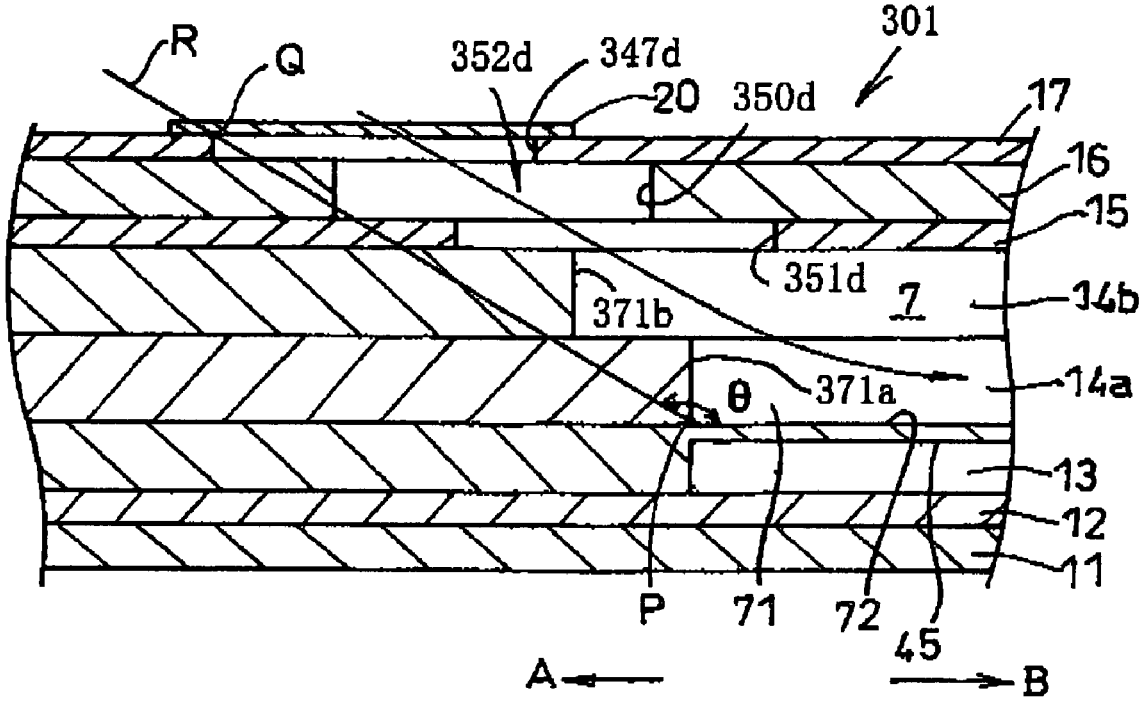
FIG. 7 is a side cross-sectional view of a connecting portion where an ink supply passage is connected to a common ink chamber, according to a third embodiment.

There will be now described an inkjet printhead according to a third embodiment, by referring to FIG. 7. The parts or elements corresponding to those of the first embodiment will be denoted by the same reference numerals and description thereof is omitted.

The inkjet printhead of the third embodiment includes a cavity unit 301 that is different from the cavity unit 1 of the first embodiment in that: (i) an uppermost stream point P in the common ink chamber 7 is, as seen in the direction perpendicular to the direction in which the ink introducing passage extends as well as the longitudinal direction of the common ink chamber, outside an open area of an ink supply port 347*d* and located on the side of the open area as indicated by arrow B, and (ii) a side wall 371*a* of a front-side one 14*a* of two manifold plates 14*a*, 14*b* through which a common ink chamber 7 is formed, which side wall 371*a* is located on the uppermost stream side in the common ink chamber 7 with respect to ink flow, is disposed on the side indicated by arrow B with respect to a side wall 371*b* of a back-side one 14*b* of the two manifold plates 14*a*, 14*b*, which side wall 371*b* is located on the uppermost stream side in the common ink chamber 7, so that a side wall of the common ink chamber 7 on the upperstream side is also stepped. Only one of the features (i) and (ii) may be separately employed.

The principal effect of the invention can be obtained whether each of the two longitudinal sides of the inner surface of the ink introducing passage is stepped to decrease the cross-sectional area of the ink introducing passage in a downward direction, or flat with inner surfaces of the plates defining the ink introducing passage flush with one another at these longitudinal sides, as shown in FIG. 6(*a*) and described above with respect to the first and second embodiments.

Each of the above-described embodiments may be adapted such that the ink introducing passage 52, 252, 352 gradually and smoothly decreases toward the front side of the cavity unit, by tapering each of the ink supply port 47 (247, 347) and the connection openings 50 (250, 350), 51 (251, 351) by design such that respective internal diameters of the ink supply port and the connection openings decrease toward the front side of the cavity unit, and then stacking the cavity plate 17, base plate 16, and supply plate 15. That is, the ink supply port and the connection openings may be tapered intentionally to predetermined dimensions, and not as a result of the etching process for forming of these port and openings as mentioned above. However, taking account of the difficulties encountered when forming small through-holes with taper in intended dimensions in a plate, the arrangement of each of the above-described embodiments where the inner surface of the ink introducing passage 52 is stepped by simply stacking the plates having through-holes, and not requiring a special step for tapering the ink supply port and connection openings which involves increase in the manufacturing cost, is preferable in view of the manufacturing cost.

In each of the above-described embodiments, the filter member 20 having filtering portions 20*a* is used. Foreign material contained in the ink supplied from the ink supply source is eliminated at the filtering portions 20*a*. Thus, introduction of foreign material into the cavity unit along with the ink is prevented. According to the present invention, occurrence of bubbles at the corner portion at the uppermost stream side of the common ink chamber is inhibited. Thus, even in the presence of the filter member covering the open end or entrance of the ink supply passage, the inkjet printhead of the invention does not suffer from the problem that bubbles are closed in the connecting portion and narrows the ink introduction passage.

The filter member has a large number of apertures to allow the ink to pass therethrough, and a total area of the apertures is smaller than an area of a major surface of the filter member. Hence, the ink flow rate inevitably decreases when passing through the filter member. In view of this, it is preferable that the cross sectional area of the ink introducing passage is larger at the upper open end thereof than at the lower open end.

In each of the above-described embodiments, between the cavity plate 17 and the manifold plate 14*b* are interposed two plates, namely, the base plate 16 and supply plate 15. However, a single plate or three or more plates may be interposed therebetween.

In each of the above-described embodiments, there is no specific relationship between the vertical dimension and the depth or horizontal dimension of the steps or shoulders in the inner surface of the ink introducing passage. However, when it is adapted such that the horizontal dimension of a shoulder increases with the vertical dimension of another shoulder immediately above that shoulder, the ink flows smoothly as well as the accumulation of bubbles is prevented.

In each of the above-described embodiments, each of the ink supply port 47 and the connection openings 50, 51 has an oblong shape in plan view. However, the shape of each of the ink supply port 47 and the connection openings 50, 51 may be circular or elliptical.

In each of the above-described embodiments, one 52*a* of the ink introducing passages 52*a*-52*d* is connected to two common ink chambers 7. However, the principle of the invention is applicable to an arrangement where an ink introducing passage 52 is connected to a single common ink chamber 7, or three or more common ink chambers 7.

What is claimed is:

1. An inkjet printhead including a cavity unit comprising:

a plurality of nozzles arranged in at least one row in a first surface of the cavity unit;

at least one common ink chamber extending along the row of the nozzles so as to distribute therefrom ink to the nozzles;

an ink introducing passage having an entrance on a second surface of the cavity unit which is opposite to the first surface, and extending toward the first surface to be connected to a first one of two opposite longitudinal end portions of the common ink chamber so as to introduce ink into the common ink chamber; and an uppermost stream point, in terms of ink flow, in a bottom surface of the common ink chamber being located, as seen in a direction perpendicular to a direction in which the ink introducing passage extends as well as a longitudinal direction of the common ink chamber, on a side of a second longitudinal end portion of the common ink chamber, with respect to an end point of the entrance of the ink introducing passage, which end point is on the side remote from the second longitudinal end portion;

wherein the cavity unit comprises a plurality of plates as stacked, wherein the common ink chamber is constituted by a through-hole formed through a first one of the plates, wherein the ink introducing passage is constituted by the entrance that is formed through a second one of the plates which is an outermost plate on the side of the second surface, and a connection opening formed through at least one third plate interposed between the first plate and the second plate, and wherein an inner surface of the ink introducing passage is stepped with at least two shoulders on the side remote from the second longitudinal end portion, by superposing the entrance and the connection opening over the first longitudinal end portion of the common ink chamber.

2. The inkjet printhead according to claim 1, further comprising:

an actuator disposed on the cavity unit so as to activate the pressure chambers selectively.

3. The inkjet printhead according to claim 1, wherein, as seen in the direction perpendicular to the direction in which the ink introducing passage extends as well as the longitudinal direction of the common ink chamber, a phantom line passing from the uppermost stream point to the end point of the entrance of the ink introducing passage is inclined with respect to the bottom surface of the common ink chamber at an angle larger than 90° but smaller than or equal to 135°.

4. The inkjet printhead according to claim 1, wherein, as seen in the direction perpendicular to the direction in which the ink introducing passage extends as well as the longitudinal direction of the common ink chamber, a phantom line passing from the uppermost stream point to the end point of the entrance of the ink introducing passage is inclined with respect to the bottom surface of the common ink chamber at an angle larger than 100° but smaller than or equal to 135°.

5. The inkjet printhead according to claim 1, wherein, as seen in the direction perpendicular to the direction in which the ink introducing passage extends as well as the longitudinal direction of the common ink chamber, a phantom line passing from the uppermost stream point to the end point of the entrance of the ink introducing passage is inclined with respect to the bottom surface of the common ink chamber at an angle larger than 110° but smaller than or equal to 135°.

6. The inkjet printhead according to claim 1, wherein, as seen in the direction perpendicular to the direction in which the ink introducing passage extends as well as the longitudinal direction of the common ink chamber, a phantom line passing from the uppermost stream point to the end point of the entrance of the ink introducing passage is inclined with respect to the bottom surface of the common ink chamber at an angle larger than 120° but smaller than or equal to 135°.

7. The inkjet printhead according to claim 1, further comprising a filter member having a filtering portion and attached on the entrance of the ink introducing passage to cover the entrance with the filtering portion.

8. The inkjet printhead according to claim 7, wherein a cross-sectional area of the ink introducing passage is larger at the side of the entrance than at the side of the common ink chamber.

9. The inkjet printhead according to claim 1, wherein a first side of an inner surface of the ink introducing passage, which is on the side of the first longitudinal end portion of the common ink chamber, is stepped, and a second side of the inner surface of the ink introducing passage, which is on the side of the second longitudinal end portion of the common ink chamber, is also stepped.

10. The inlet printhead according to claim 9, wherein the second side of the inner surface of the ink introducing passage is stepped downward in a direction toward the first longitudinal end portion of the common ink chamber.

11. The inkjet printhead according to claim 9, wherein the second side of the inner surface of the ink introducing passage is stepped downward in a direction toward the second longitudinal end portion of the common ink chamber.

12. The inkjet printhead according to claim 11, wherein the uppermost stream point in the bottom surface of the common ink chamber is located on the downstream side of an end point of the entrance of the ink introducing passage, which end point is on the side near the second longitudinal end portion.

13. The inkjet printhead according to claim 1, wherein a first side of an inner surface of the ink introducing passage, which is on the side of the first longitudinal end portion of the common ink chamber, is stepped, and a second side of the inner surface of the ink introducing passage, which is on the side of the second longitudinal end portion of the common ink chamber, is flat.

14. The inkjet printhead according to claim 1, wherein the cavity unit is constituted by a stack of a plurality of plates including at least two manifold plates, wherein the common ink chamber is constituted by through-holes respectively formed through the at least two manifold plates, wherein the through-holes of the manifold plates are disposed such that the inner surface of the common ink chamber is stepped downward on the side remote from the second longitudinal end portion in a direction toward the second longitudinal end portion.

15. An inkjet printhead including a cavity unit comprising:

a plurality of nozzles arranged in at least one row in a first surface of the cavity unit;

at least one common ink chamber extending along the row of the nozzles so as to distribute therefrom ink to the nozzles;

an ink introducing passage having an entrance on a second surface of the cavity unit which is opposite to the first surface, and extending toward the first surface to be connected to a first one of two opposite longitudinal end portions of the common ink chamber so as to introduce ink into the common ink chamber; and an uppermost stream point, in terms of ink flow, in a bottom surface of the common ink chamber being located, as seen in a direction perpendicular to a direction in which the ink introducing passage extends as well as a longitudinal direction of the common ink chamber, on a side of a second longitudinal end portion of the common ink chamber, with respect to an end point of the entrance of the ink introducing passage, which end point is on the side remote from the second longitudinal end portion;

wherein an inner surface of the ink introducing passage is stepped with at least two shoulders on the side remote from the second longitudinal end portion, and depth dimensions of the shoulders are different.

* * * * *

UNITED STATES PATENT AND TRADEMARK OFFICE

CERTIFICATE OF CORRECTION

PATENT NO. : 7,611,231 B2
APPLICATION NO. : 11/258313
DATED : November 3, 2009
INVENTOR(S) : Atsushi Ito It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 798 days.

Signed and Sealed this

Twelfth Day of October, 2010

David J. Kappos

David J. Kappos
*Director of the United States Patent and Trademark Office*